US005170815A

United States Patent [19]

Going, III et al.

[11] Patent Number: 5,170,815

[45] Date of Patent: Dec. 15, 1992

[54] COILED TUBING GAS LIFT ASSEMBLY

[75] Inventors: Walter S. Going, III; Ronald E. Pringle, both of Houston, Tex.

[73] Assignee: Camo International Inc., Houston, Tex.

[21] Appl. No.: 840,254

[22] Filed: Feb. 24, 1992

[51] Int. Cl.[5] ..... E21B 19/22; E21B 34/06

[52] U.S. Cl. ..... 137/155; 166/77; 166/380

[58] Field of Search ..... 137/155; 166/77, 380

[56] References Cited

U.S. PATENT DOCUMENTS 3,042,065 7/1962 Graves ..... 137/155

3,294,108 12/1966 Thrash ..... 137/155

4,844,166 7/1989 Going, III et al. ..... 166/379

*Primary Examiner*—Alan Cohan

*Attorney, Agent, or Firm*—Fulbright & Jaworski

[57] ABSTRACT

A gas lift assembly for installation in the interior of coiled tubing for providing gas lift to oil and gas wells. A housing assembly for receiving a gas lift valve is adapted to be connected in a coiled tubing and includes a tubular member having a bore with a holding shoulder in the bore of the tubing for holding a gas lift valve and a port. Preferably at least one passage way is provided for allowing fluids to pass when the gas lift valve is positioned in the bore. The gas lift valve may be of various geometries and materials for allowing the gas lift valve to be run into the well with the coiled tubing.

16 Claims, 4 Drawing Sheets

COILED TUBING GAS LIFT ASSEMBLY

BACKGROUND OF THE INVENTION

The present invention is directed to well tools for oil and gas wells for mounting gas lift valves internally of coiled tubing.

The use of gas lift valves connected to the outside of coiled tubing for providing gas lift to the interior of production well tubing is disclosed in U.S. Pat. No. 4,844,166. However, such externally connected gas lift mandrels have the disadvantage that they cannot be conveniently lowered through various well head equipment, nor can they be satisfactorily reeled onto the reel as the coiled tubing is installed into and removed from the production tubing string, and they extend into and restrict the annulus between the coiled tubing and the production tubing.

The present invention is directed to a gas lift assembly in which the gas lift valves are mounted internally of the coiled tubing and have the advantages that they may connected in the coiled tubing and stored on a coiled tubing reel, and may be injected through well head equipment which distorts the coiled tubing into an oval shape for passage through the injector head.

SUMMARY

The present invention is directed to a coiled tubing housing assembly for receiving a gas lift valve and includes a tubular member having a bore therethrough and having first and second ends adapted to be connected in a coiled tubing. The tubular member is adapted to receive a gas lift valve in the bore between the first and second ends. A port between the first and second ends extend between the inside and outside of the tubular member for passage of fluids. Holding means are provided in the bore for engaging and holding a gas lift valve in the bore. Preferably the housing assembly has substantially the same outside diameter and substantially the same thickness as the coiled tubing whereby the housing assembly may be handled and installed in the same manner as coiled tubing. And in one embodiment at least one passage way is provided in the bore adjacent the inside of the tubular member for allowing fluids to pass when the gas lift valve is positioned in the bore.

A still further object of the present invention is wherein a gas lift valve is positioned and held in the bore of the tubular member. In one embodiment the gas lift valve is of a geometric length so that it may remain in the coiled tubing and reeled onto the coiled tubing reel without damage. In another embodiment the coiled tubing housing and gas lift valve may be installed into the coiled tubing at the well site as tubing is run into the well and in this case the gas lift valve need not be sized to be wound up onto a coiled tubing reel. And in a still further embodiment the gas lift valve may be provided with sufficient flexibility to coil around a coil tubing reel. That is, in one example the valve may include a non-metallic flexible body and/or other parts for allowing bending about the longitudinal axis of the body.

Still a further object of the present invention is where in the holding means include an upwardly directed shoulder and a downwardly directed shoulder in the bore. Such a holding means would allow a valve having a body including a first shoulder for engaging one of the shoulder in the bore and a releasable cap on one end of the body for engaging the other of the shoulders of the bore, to be positioned and held in the bore of the tubular member.

Yet still a further object of the present invention is wherein the passageway includes a plurality of longitudinally extending parallel passageways positioned around the bore.

Still a further object of the present invention is a provision of a receptable in the bore integral with the tubular member through which the port extends. The receptacle includes tapered ends and the holding means includes a shoulder at each end of the receptable. The receptacle includes a plurality of longitudinal extending parallel passageways.

A further object of the present invention is the provision of a gas lift valve having an elongated body with an inlet, and outlet, a valve actuated by gas-containing compartment, and a check valve in which the valve has sufficient flexibility to coil around a coiled tubing reel and resiliently return to its original elongate position when the coiled tubing is unwound from the reel. In one embodiment the gas-containing compartment may include a non-metallic material. In another embodiment the gas-containing compartment is a molded plastic wire reinforced bladder. If desired, support disks may be provided in the bladder for supporting the bladder. In addition, a flexible body may be provided about the bladder. In a further embodiment the valve includes a plurality of non-metallic flexible and resilient longitudinally extending parts for allowing the valve to bend about the longitudinal axis of the valve.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

The present invention will be described as various individual types of gas lift assemblies, for particularly pointing out the claimed invention. However, it is to be understood that each coiled tubing may include one or more of the gas lift assemblies of the present invention vertically connected in the coiled tubing and spaced from each other as is done in conventional gas lift systems. Furthermore, while the specific disclosed gas lift structures illustrates the method of injecting lift gas downwardly through the coiled tubing and discharging through each gas lift assembly into the annulus between the coiled tubing and the production tubing thereby lifting well fluids in the annulus, it is also possible to reverse the direction of flow by reversing the check valve assemblies in the gas lift valve. In this manner, lift gas can be injected into the annulus between the coiled tubing and the production tubing and then enter into the bore of the coiled tubing via the gas lift assemblies thereby lifting the well fluids in the bore of the coiled tubing.

Figure 1A:
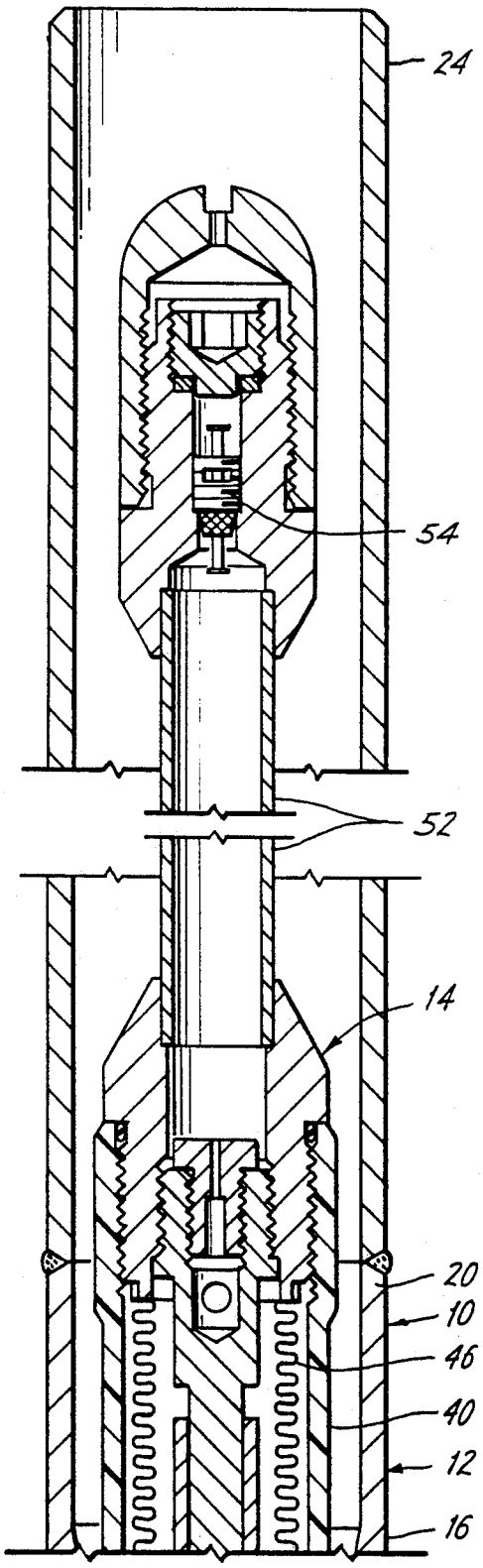
FIGS. 1A and 1B are continuations of each other and form a fragmentary elevational view, in cross-section, of the present invention.
Figure 1B:
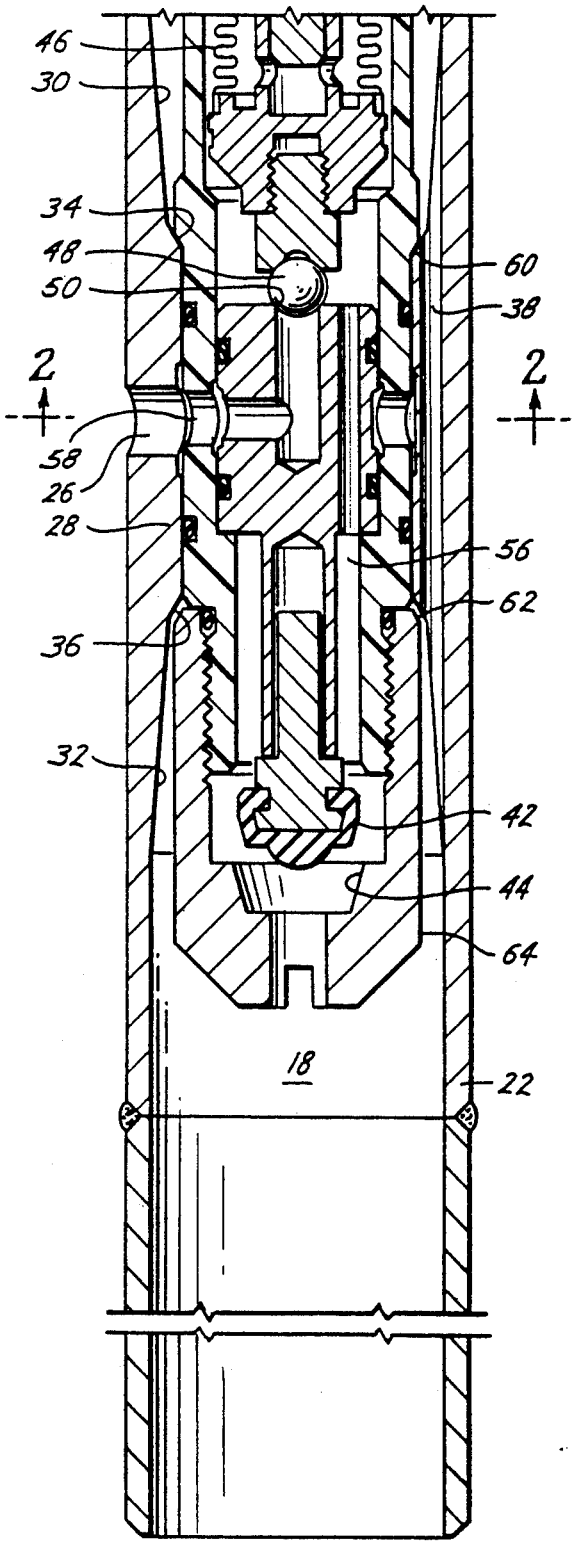
Figure 2:
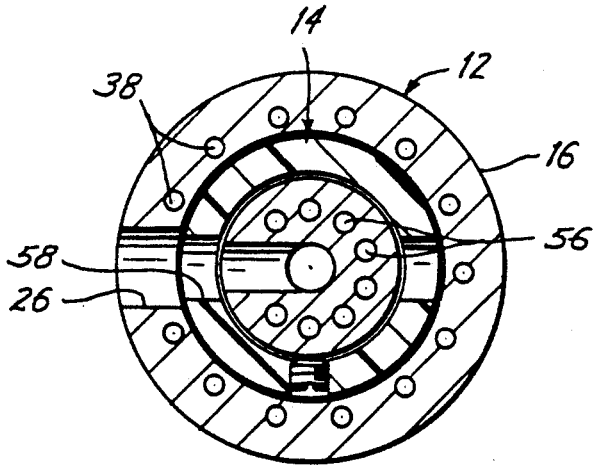
FIG. 2 is a cross-section view taken along the line 2—2 of FIG. 1B, FIGS. 3A and 3B are continuations of each other and form a fragmentary elevational view, in cross-section, of another embodiment of a gas lift valve of the present invention.

Referring now to the drawings, particularly to FIGS. 1A, 1B and 2, the reference numeral 10 generally indicates the coiled tubing gas lift assembly and generally includes a coiled tubing housing assembly 12 and a gas lift valve 14.

The housing includes a tubular member 16 having a bore 18 there through and having a first end 20 and a second end 22 adapted to be connected in a coiled tubing 24. In the case of supplying a coiled tubing assembly ready to run continuously, the preferred method of coupling the housing 14 to the coiled tubing 24 is by full penetration welding of the ends 20 and 22 into the coiled tubing 24. Alternatively, the housing 12 may be coupled to the coiled tubing 24 by connectors as disclosed in U.S. Pat. No. 4,844,166 or by connectors which grip the internal diameter of both the housing 12 and the coil tubing 24 such as disclosed in U.S. patent application Ser. No. 07/744,152 filed Aug. 13, 1991 entitled METHOD AND APPARATUS FOR INTERNALLY CONNECTING TO COILED TUBING. Preferably, the tubular member 16 has substantially the same outside diameter and substantially the same thickness as the coiled tubing 24, which is advantageous in coiling the assembly on a coiled tubing reel and for ease of feeding the coiled tubing through well head equipment such an injector.

The tubular member 16 includes a laterally extending port 26 for the passage of fluids between the inside and the outside of the tubular member 16. The tubular member 16 is adapted to receive a gas lift valve 14 within the bore 18 within the first and second ends 20 and 22 although the valve 14 may extend beyond the ends as shown in FIGS. 1A and 1B.

Furthermore, holding means are provided in the bore 18 for engaging and holding the gas lift valve 14 in the bore 18. And in the preferred embodiment in FIGS. 1A and 1B at least one passageway 38 is provided in the bore 18 adjacent the inside of the tubular member 16 for allowing fluids to pass when the gas lift valve 14 is positioned in the bore 18. Preferably, this structure may be provided by a receptacle 28 in the bore 18 which is integral with the tubular member 16 and through which the port 26 extends. The receptacle 28 preferably includes a tapered upper end 30 and a tapered lower end 32 which includes a first upwardly directed shoulder 34 and a second downwardly facing shoulder 36 which provides a holding means in the bore for engaging and holding a gas lift valve 14 in the bore 18. The receptacle 28 includes at least one and preferably a plurality of longitudinally extending parallel passageways 38 allowing fluids to pass upwardly or downwardly in the coiled tubing when the gas lift valve 14 is positioned in the bore 18. This allows communication between other gas lift valves above and below the valve 14, allows the passage of injection fluids downwardly through the coiled tubing 24 or lifting well fluids upwardly through the coiled tubing 24. The advantage of the tapered ends 30 and 32 and holding shoulders 34 and 36 is that the transition from the thin wall section to the valve receptacle section 28 along a gradually tapered length, and the absence of any abrupt changes in the wall section of the receptacle 28 for holding the gas lift valve 24 minimize stress concentrations as the housing 12 is laterally bent and spooled onto a coiled tubing reel.

There referring to FIGS. 1A, 1B and 2, the gas lift valve 14 is positioned in and held in the bore 18 of the tubular member 16. The gas lift valve 14 includes a body 40, a reverse flow check valve consisting of a valve element 42 which normally seats on a valve seat 44 and which may be spring biased (not shown) to the closed position. A gas charge bellows 46 normally urges a valve element 48 to a closed position on seat 50. A gas containing compartment 52 is charged through a dill valve 54 to transmit a pressurized gas charge, such as nitrogen to the inside of the bellows 46. The valve 14 is actuated by injection pressure flowing down the inside of the coil tubing 24, through the passageways 38, into and opening the check valve 42, and up through ducts 56 to act on the outside of the bellows 46 to open the valve element 48. This allows the injection gas to flow out of valve outlet 58 and through the port 26 and into the annulus between the assembly 10 and the production tubing (not shown) thereby lifting the well fluids in the annulus. The general operating components of the gas lift valve 14 are well known and are similar to gas lift valve type J-40 and BK series sold by Camco International Inc. However, the gas lift valve 14 is provided with coacting means for coacting with the receptacle 28 and the upwardly facing shoulder 34 and the downwardly facing shoulder 36. Thus, the valve body 40 is provided with a downwardly facing shoulder 60 for coacting with the upwardly facing shoulder 34 and includes an upwardly facing shoulder 62 for coacting with the downwardly facing shoulder 36. The upwardly facing shoulder 62 is positioned on a check valve cap 64 which is threadably connected to the body 40 for positioning and holding the gas lift valve 14 in the coiled tube housing 12. Therefore, the gas lift valve 14 has the advantage of being on the inside of the coiled tubing instead of the outside and therefore avoids interfering with and restricting the annulus between the coiled tubing and the well production tubing (not shown).

Normally, the parts of a gas lift valve are made of metal and therefore are rigid and inflexible. However, if the overall length of the gas lift valve is short enough, the coiled tubing 24 with a gas lift valve 14 may be wound onto a normal coiled tubing reel (not shown), for example, one having a radius of thirty-six inches. Normally, all metal gas lift valves of smaller sizes, such as ⅝ths inch OD, will meet this criteria. However, larger gas lift valves do not normally have a valve geometry which would allow them to be wound upon the reel of coiled tubing without the possibility of damaging the predictability and repeatability of the valve mechanics if the movable parts of the valve were allowed to bend.

Therefore, as an alternative the gas containing compartment 52 such as a metal nitrogen dome chamber are being made of metal may be made relatively thin by comparison to the body 16 such that the overall valve 14 will readily deform to the curvature of the coiled tubing. In so doing the chamber 52 may be made to any reasonable length and this has the advantage of providing a much larger nitrogen chamber which is preferable from the standpoint of good gas lift valve mechanics.

In any event, it is advantageous to provide a gas lift valve having sufficient flexibility to coil around a coil tubing reel and resiliently return to its original elongate position when the coiled tubing is unwound from the wheel. It is also advantageous that the valve be flexible and resilient as the coiled tubing 24 and any gas lift valve therein goes through certain equipment in the well head such as the injector, the normally round cross-sectional coiled tubing and safety valve will be clamped into an oval cross-section. Therefore, as another embodiment, the valve 14 may include non-metallic flexible parts for allowing bending about the longitudinal axis of the body 40. For example the body 40 may be made out of a suitable non-metallic material such as a plastic and in particular such as PEEK the generic name being polyetheretherketone. And of course other longitudinal extending parts may be made of non-metallic and resilient materials for allowing the valve to bend about the longitudinal housing 40.

Other and further embodiments other than those previously described will be further disclosed wherein like parts to those numbered in FIGS. 1A, 1B and 2 will be similarly numbered with the addition of suffixes "a" and "b".

Figure 4:
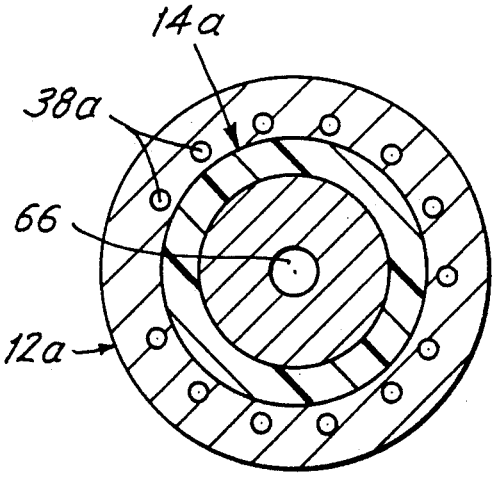
FIG. 4 is a cross-sectional view taken along the line 4—4 of FIG. 3B, FIGS. 5A and 5B are continuations of each other and form a fragmentary elevational view, in cross-section, of another embodiment of the present invention.
Figure 3A:
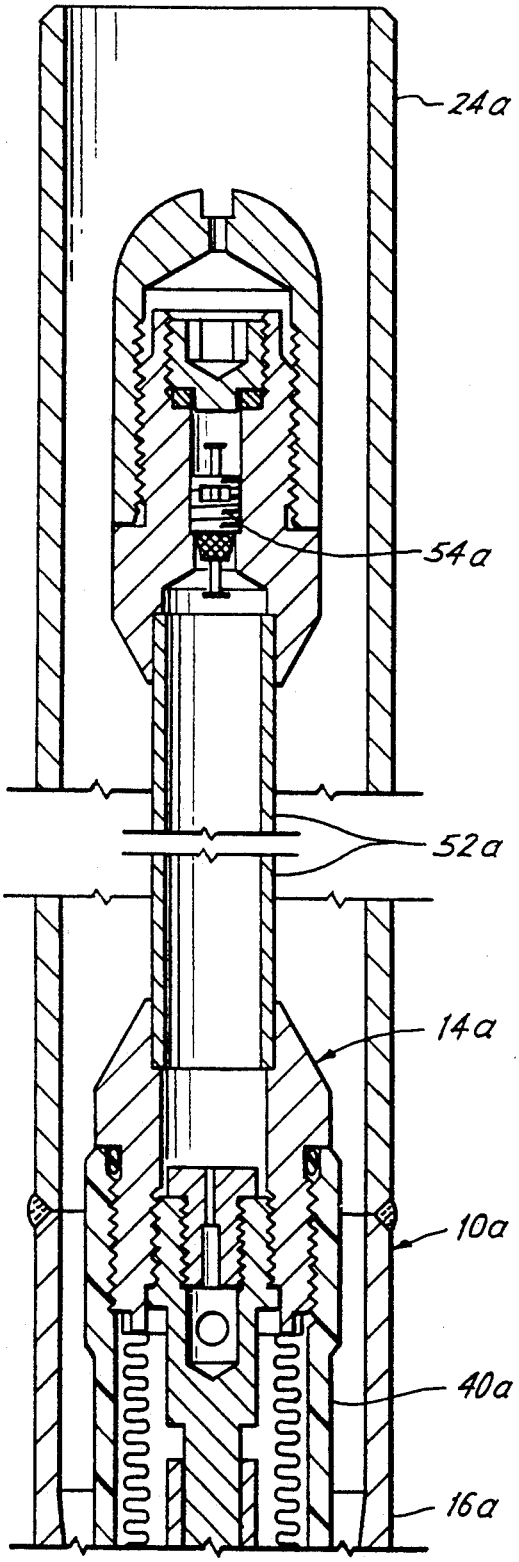
Figure 3B:
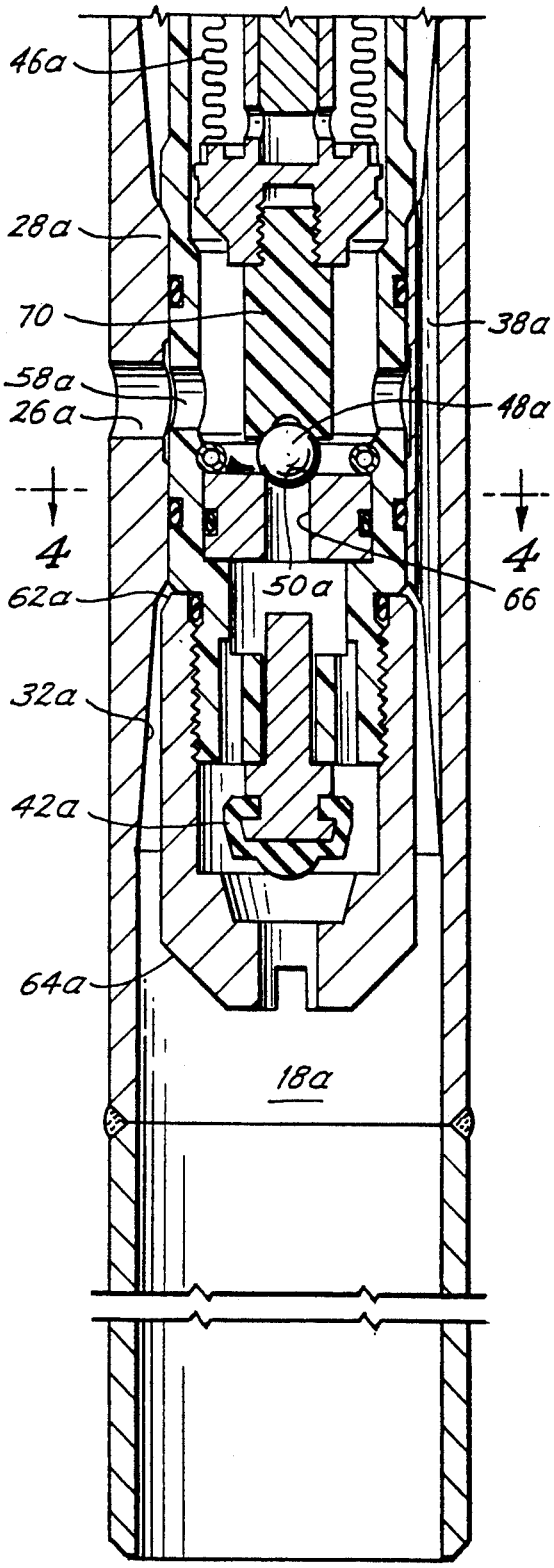

The valve structure shown in FIGS. 3A, 3B and 4 have similar components to the valve 14, but are arranged such that the production pressure in the annulus between the assembly 10*a* and the production tubing is exposed through the bellows 46*a*. In operation, injection gas is again transmitted down the interior of the coiled tubing 24*a* through the passageways 38*a*, through the check valve element 42*a* and into duct 66 against the bottom of the valve element 48*a*. In this arrangement the high pressure of the injection gas acts on the small cross sectional area of the valve element 48*a* to open the bellows control valve and the injection gas flows out the ports 58*a* and 26*a* into the annulus to provide lifting gas to lift the well fluids in the annulus. The structure of the valve 14*a* is somewhat similar to gas lift valve type R-25 and J-20 with check valve sold by Camco International Inc. While it is to be noted that the gas lift valves 14 and 14*a* operate by injecting lift gas downwardly through the coiled tubing 24 and 24*a*, respectively and discharging through the gas lift assembly 10 and 10*a* into the annulus between the coiled tubing and the production tubing, other types of gas lift valves may be used. For example, by reversing the operation of check valves 42 and 42*a*, respectively a gas lift valve may be provided in which the injection gas is injected into the annulus between the coiled tubing and the production tubing and then enters into the bore of the coiled tubing via the gas lift valves thereby lifting the well fluids through the interior of the coiled tubing.

In the embodiments of FIGS. 3A, 3B and 4 a plug (not shown) would be connected to the lower end of the coiled tubing 24*a* in order to properly direct the flow of the injection gas. Again, the gas lift valve 14*a*, in larger sizes, would be advantageously made of materials which includes a plurality of non-metallic flexible and resilient longitudinal extending parts for allowing the valve to bend about the longitudinal axis of the valve. For example, the body 40, and the valve element stem tip actuator 70 may be made of suitable resilient material such as PEEK.

Figure 6:
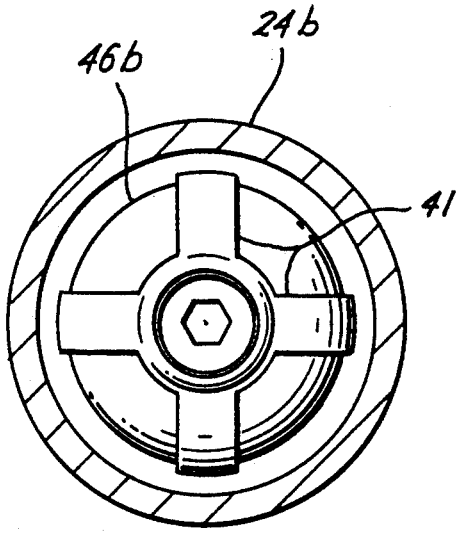
FIG. 6 is a cross-sectional view taken along the line of 6—6 of FIG. 5A.
Figure 5A:
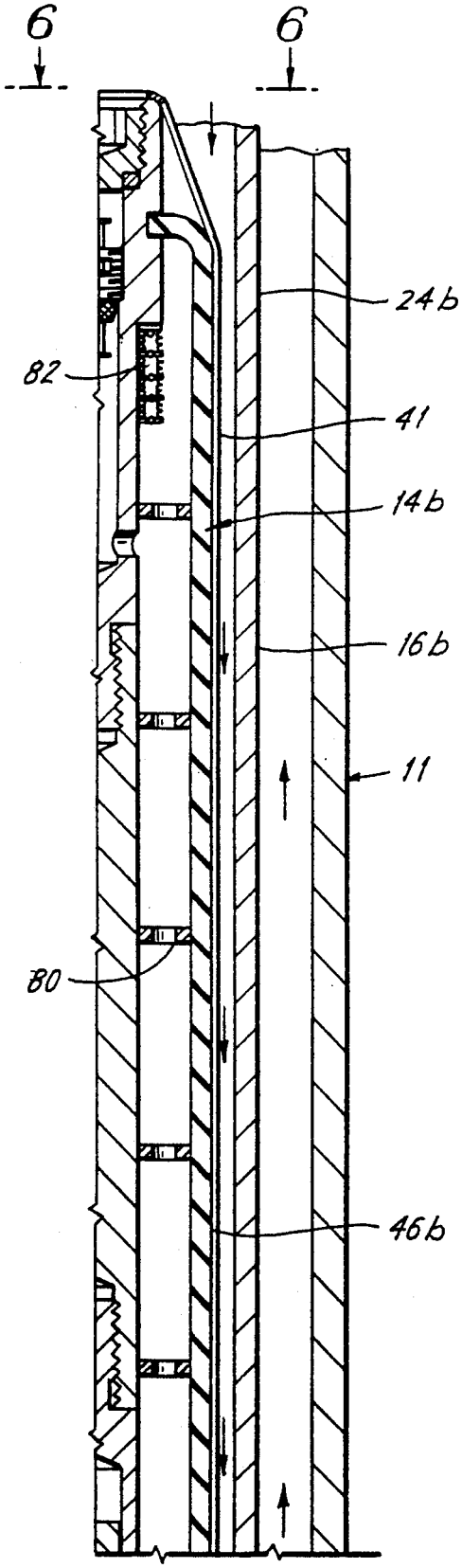
Figure 5B:
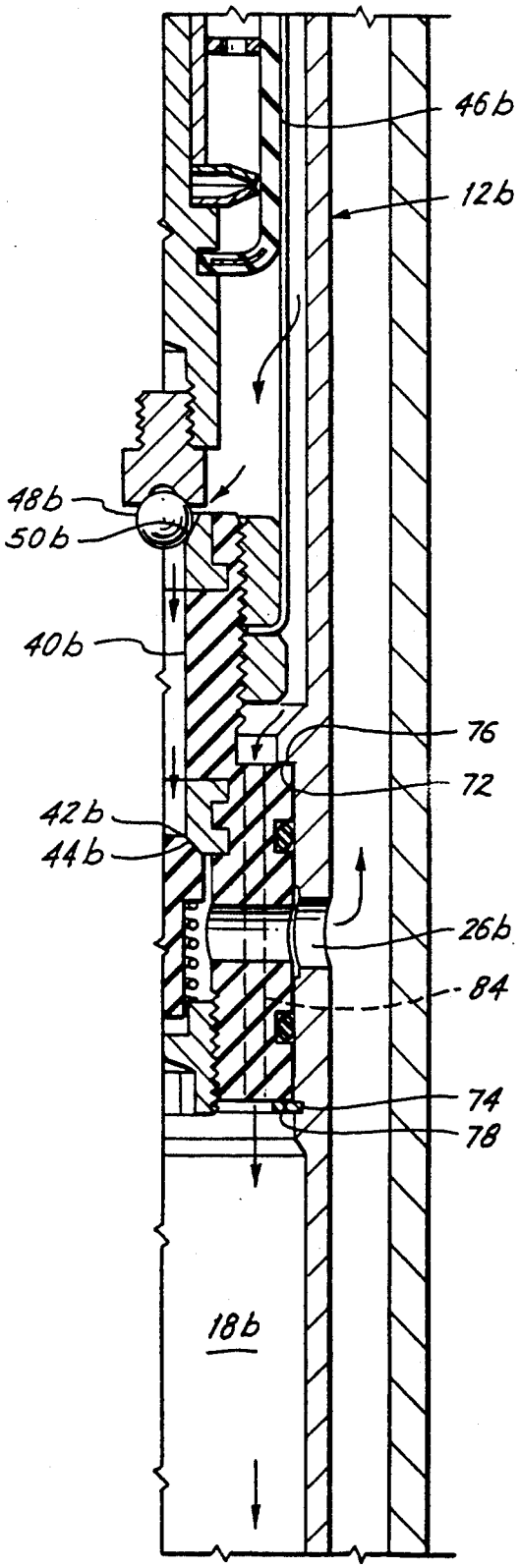

Referring now to FIGS. 5A, 5B, and 6, the coiled tubing houring 12*b* includes a tubular member 16*b* having a bore 18*b* therethrough which is adapted to be connected in coiled tubing 24*b* and receive a gas lift valve 14*b* therein, all of which is positioned in production tubing 11. In addition a tubular member 16*b* includes a port 26*b* and holding means in the bore 18*b* for engaging and holding the gas lift valve 14*b*. In this case the holding means includes a shoulder 72 and snap ring 74 for engaging upwardly directed shoulders 76 and downwardly directed shoulder 78 on the gas lift valve 14*b*. However, the fluid passageways are ommitted from the housing 12*b* and instead are provided in the gas lift valve 14*b* as will be more fully described herein after. This embodiment also differs in that the gas-containing compartment 46*b* is a bladder, instead of the typical metal bellows, preferably a reinforced high pressure hose and wire wrap or metal straps 41 may be provided for support if desired. The body 40*b* may be molded of a suitable elastomer, Viton, and wire reinforced. And many of the other parts of the valve are made of flexible non-metallic materials with the possible exception of the valve elements 42*b* and 48*b* and the valve seats 44*b* and 50*b*, respectively. If necessary, support disks 80 may be provided internally of the bladder 46*b*. A volume compensator 82 may be provided for maintaining the charge pressure in the bladder 46*b* and keep it from being changed by the injection pressure flowing down the coiled tubing 24*b*. It is also noted that gas passageways 84 may be provided in the gas lift valve 14*b* for allowing the flow of fluids through the assembly 10*b* when the gas lift valve 14*b* is in place.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, will readily suggest themselves to those skilled in the art and which are encompassed with the spirit of the invention and the scope of the appended claims.

What is claimed is:

1. A coiled tubing housing assembly for receiving a gas lift valve comprising, a coiled tubing tubular member having a bore therethrough and having first and second ends, said tubular member adapted to receive a gas lift valve in the bore within the first and second ends, a port between the first and second ends extending between the inside and the outside of the tubular member, holding means in the bore for engaging and holding a gas lift valve in the bore, and at least one passageway in the bore adjacent the inside of the tubular member for allowing fluids to pass around the outside of a gas lift valve positioned in the bore.

2. The apparatus of claim 1 wherein the housing assembly has substantially the same outside diameter and substantially the same thickness as the coiled tubing.

3. The apparatus of claim 1 including, a gas lift valve positioned in and held in the bore of the tubular member.

4. The apparatus of claim 3 wherein the valve includes a non-metallic flexible body for allowing bending about the longitudinal axis of the body.

5. The apparatus of claim 1 wherein the holding means includes an upwardly directed shoulder and a downwardly directed shoulder in the bore.

6. The apparatus of claim 5 including, a gas lift valve positioned in the bore of the tubular member, said valve having a body including a first shoulder for engaging one of the shoulders in the bore, a releasable cap on one end of the body for engaging the other of the shoulders in the bore.

7. The apparatus of claim 1 wherein said passageway includes a plurality of longitudinally extending parallel passageways positioned around the bore.

8. The apparatus of claim 1 including, a receptacle in the bore integral with the tubular member through which the port extends, said receptacle includes tapered ends and the holding means includes a shoulder at each end of the receptacle, and said receptacle includes a plurality of longitudinally extending parallel passageways.

9. In a gas lift valve have an elongate body with an inlet, an outlet, a valve controlled by a gas containing compartment, and a check valve, the improvement comprising, said valve having sufficient flexibility to coil around a coiled tubing reel and resiliently return to its original elongate position when the coiled tubing is unwound from the reel.

10. The valve of claim 9 wherein said body being an elongate non-metallic flexible body for allowing bending about the longitudinal axis of the body.

11. The valve of claim 9 wherein said valve includes a pluraltiy of non-metallic flexible and resilient longitudinally extending parts for allowing the valve to bend about the longitudinal axis of the valve.

12. A coiled tubing housing assembly for receiving a gas lift valve comprising, a tubular member having a bore therethrough and having first and second ends adapted to be connected in a coiled tubing, said tubular member adapted to receive a gas lift valve in the bore between the first and second ends, a port between the first and second ends extending between the inside and the outside of the tubular member, and holding means in the bore for engaging and holding a gas lift valve in the bore, said gas lift valve positioned in and held in the bore of the tubular member, a passageway in one of the tubular member and the gas lift valve for allowing fluid to pass through the member when the gas lift valve is positioned in the bore, and said valve includes a plurality of non-metallic flexible and resilient longitudinally extending parts for allowing the valve to bend about the longitudinal axis of the valve.

13. The valve of claim 12 wherein the valve includes a gas containing compartment formed by a non-metallic flexible material.

14. The valve of claim 13 wherein the gas containing compartment is molded plastic wire reinforced bladder.

15. The valve of claim 14 including, support discs in the bladder for supporting the bladder.

16. The valve of claim 14 including, a flexible body about the bladder.

* * * * *

UNITED STATES PATENT AND TRADEMARK OFFICE

CERTIFICATE OF CORRECTION

PATENT NO. :5,170,815

DATED :December 15, 1992

INVENTOR(S) :Walter S. Going, III et al

It is certified that error appears in the above-indentified patent and that said Letters Patent is hereby corrected as shown below:

On the title page: correct the assignee's name from "Camo" to -- Camco --

Column 1, line 67, delete "shoulder" and replace it with -- shoulders --

Column 5, line 64, delete "houring" and replace it with -- housing --

Column 6, line 6, delete "ommitted" and replace it with - omitted --

Column 6, line 40, after "ends" insert -- connected in a coiled tubing --

Signed and Sealed this

Twenty-sixth Day of October, 1993

*Attest:*

Bruce Lehman

BRUCE LEHMAN

*Attesting Officer*

*Commissioner of Patents and Trademarks*